US010590732B2

(12) United States Patent
Ingram

(10) Patent No.: US 10,590,732 B2
(45) Date of Patent: Mar. 17, 2020

(54) PACKING ELEMENT BOOSTER WITH RATCHET MECHANISM

(71) Applicant: Weatherford Technology Holdings, LLC, Houston, TX (US)

(72) Inventor: Gary Duron Ingram, Richmond, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 136 days.

(21) Appl. No.: 15/847,706

(22) Filed: Dec. 19, 2017

(65) Prior Publication Data

US 2019/0186232 A1 Jun. 20, 2019

(51) Int. Cl.

| | |
|---|---|
| ***E21B 33/128*** | (2006.01) |
| ***E21B 33/129*** | (2006.01) |
| ***E21B 33/12*** | (2006.01) |

(52) U.S. Cl.

CPC ..... *E21B 33/1285* (2013.01); *E21B 33/12* (2013.01); *E21B 33/128* (2013.01); *E21B 33/129* (2013.01); *E21B 33/1293* (2013.01)

(58) Field of Classification Search

CPC .... E21B 33/129; E21B 33/12; E21B 33/1292; E21B 23/00

See application file for complete search history.

(56) References Cited

U.S. PATENT DOCUMENTS 2,228,242 A 1/1941 Baker
3,180,419 A 4/1965 Cochran
4,018,274 A 4/1977 Chochran
4,044,826 A * 8/1977 Crowe ..... E21B 23/06 166/120
4,662,450 A * 5/1987 Haugen ..... E21B 23/065 166/181
4,791,992 A * 12/1988 Greenlee ..... E21B 33/128 166/187
4,898,239 A * 2/1990 Rosenthal ..... E21B 23/065 166/133

(Continued)

FOREIGN PATENT DOCUMENTS

WO 2012068672 A1 5/2012

OTHER PUBLICATIONS

Int'l Search Report and Written Opinion received in copending PCT Application No. PCT/US2018/059437 dated Feb. 19, 2019, 12 pages.

*Primary Examiner* — Blake E Michener
*Assistant Examiner* — Theodore N Yao
(74) *Attorney, Agent, or Firm* — Blank Rome, LLP

(57) ABSTRACT

A packer for sealing in a tubular includes a mandrel on which a packing element is disposed between booster pistons. Each piston defines a sealed chamber with housed areas of the mandrel. A setting force compresses packing element between the booster piston, which shear free. Ratchet mechanisms including ratchet sleeves and body lock rings disposed between the pistons and the housed areas initially allow the pistons to move in a direction away from the packing element, which expands the respective sealed chamber. Thereafter, in response to a pressure differential across the respective sealed chamber, the ratchet mechanisms each permit urging of the respective piston toward the packing element while preventing retraction of respective piston in the opposite direction.

22 Claims, 3 Drawing Sheets

(56) References Cited

U.S. PATENT DOCUMENTS

| | | | | |
|---|---|---|---|---|
| 4,924,941 | A * | 5/1990 | Farley | E21B 33/124 166/134 |
| 5,058,673 | A | 10/1991 | Muller et al. | |
| 5,810,082 | A | 9/1998 | Jordan | |
| 5,857,520 | A | 1/1999 | Mullen et al. | |
| 8,439,107 | B2 * | 5/2013 | Xu | E21B 23/00 166/125 |
| 8,881,836 | B2 | 11/2014 | Ingram | |
| 2005/0000692 | A1 | 1/2005 | Cook et al. | |
| 2005/0077053 | A1 * | 4/2005 | Walker | E21B 33/1295 166/387 |
| 2005/0155775 | A1 | 7/2005 | Hirth et al. | |
| 2008/0053652 | A1 | 3/2008 | Corre et al. | |
| 2008/0202771 | A1 | 8/2008 | Carisella et al. | |
| 2009/0038802 | A1 * | 2/2009 | Lucas | E21B 33/12 166/299 |
| 2012/0125640 | A1 * | 5/2012 | Sevre | E21B 33/1208 166/387 |

* cited by examiner

PACKING ELEMENT BOOSTER WITH RATCHET MECHANISM

FIELD OF THE DISCLOSURE

The subject matter of the present disclosure generally relates to completion operations in a wellbore. More particularly, the subject matter relates to a packer for sealing an annular area between two tubular members within a wellbore. More particularly still, the subject matter relates to a packer having a bi-directionally boosted and held packing element.

BACKGROUND OF THE DISCLOSURE

During the wellbore completion process, a packer is run into the wellbore to seal off an annular area. Known packers employ a mechanical or hydraulic force in order to expand a packing element outwardly from the body of the packer and into the annulus defined between the packer and the surrounding casing. In addition, a cone can be driven behind a tapered slip to force the slip into the surrounding casing to prevent packer movement. Numerous arrangements have been derived in order to accomplish these results.

A disadvantage with known packer systems is the potential for becoming unseated. In this regard, wellbore pressures existing within the annulus between an inner tubular and the outer casing act against the packer's setting mechanisms, creating the potential for at least partial unseating of the packing element.

Generally, the slip used to prevent packer movement traps an internal pressure into the packing element from the initial force used to expand the packing element. During well operations, a differential pressure applied across the packing element may fluctuate due to changes in formation pressure or operation pressures in the wellbore. When the differential pressure approaches or exceeds the initial internal pressure of the packing element, the packing element may be compressed further by the differential pressure, thereby causing it to extrude into smaller voids and gaps or exceed the compression strength of the packing element. Thereafter, when the pressure is decreased, the packing element begins to relax. However, the internal pressure of the packing element may fall below the initial level due to the volume transfer and/or the compression setting of the packing element during extrusion. The reduction in internal pressure decreases the packing element's ability to maintain a seal with the wellbore when a subsequent differential pressure is applied or when the direction of pressure is changed, i.e., uphole to downhole.

Due to these issues, packers have been designed that are able to pack-off against a hydraulic cylinder, such as a boost mechanism, which can then trap a boost force into the packer's packing element. One such packer with a boost mechanism is disclosed in U.S. Pat. No. 8,881,836, which is incorporated herein by reference.

The subject matter of the present disclosure is directed to overcoming, or at least reducing the effects of, one or more of the problems set forth above.

SUMMARY OF THE DISCLOSURE

According to the present disclosure, a packer for setting in a tubular with a setting force comprises a mandrel, a first piston, a packing element, and a first ratchet mechanism. The mandrel defines a first housed area, and the first piston movably disposed on the mandrel has first end defining a first sealed pressure chamber with the first housed area of the mandrel. The packing element is movably disposed on the mandrel and is compressible on a first side against a second end of the first piston in response to the setting force to seal against the tubular. The first ratchet mechanism is disposed between the first piston and the first housed area. The first ratchet mechanism in an initial condition permits movement of the first piston in a first direction away from the packing element expanding the first sealed pressure chamber, whereas the first ratchet mechanism in a subsequent condition permits urging of the first piston in a second opposite direction toward the packing element in response to a first pressure differential across the first sealed pressure chamber and prevents retraction of first piston in the first direction.

The second end of the piston can comprise a gage ring disposed adjacent the packing element. The piston can comprise an internal sleeve movably disposed on the mandrel. For its part, the mandrel can comprise an external sleeve affixed to the mandrel and disposed about the internal sleeve to define the first housed area. The internal and external sleeves can have seals engaging one another and sealing the sealed pressure chamber there between.

In one configuration, the first ratchet mechanism comprises an intermediate sleeve disposed between the piston and the first housed area and having a first ratchet surface. The piston has an external ratchet surface configured to slip past the first ratchet surface with movement of the piston in the first direction and configured to catch the first ratchet surface with movement of the piston in the second direction.

In this configuration, the intermediate sleeve can comprise a second ratchet surface, and the ratchet mechanism can comprise a body lock ring disposed between the intermediate sleeve and the first housed area. The body lock ring can have an internal ratchet surface configured to catch the second ratchet surface with movement of the intermediate sleeve in the first direction and configured to slip past the second ratchet surface with movement of the intermediate sleeve in the second direction.

In this configuration, the body lock ring can comprise a wedged or perpendicular surface disposed on the upper side thereof and engaged with a complementary wedged or perpendicular surface disposed on an under side of the mandrel in the first housed area. The complementary surfaces urged in the first direction causing radial contraction of the body lock ring and urged in the second direction permitting radial expansion of the body lock ring.

The piston can comprise a connection temporarily affixing the piston to the mandrel, the connection breaking in response to a level of the setting force.

The packer can further comprise a body movably disposed on the mandrel on an opposite side of the packing element and defining a second housed area. A second piston movably disposed on the mandrel can have a third end defining a second sealed pressure chamber with the second housed area of the mandrel. A second ratchet mechanism can be disposed between the second piston and the second housed area. The second ratchet mechanism in an initial condition can permit movement of the second piston in the first direction away from the packing element expanding the second sealed pressure chamber, whereas the second ratchet mechanism in a subsequent condition permits urging of the second piston in the second opposite direction toward the packing element in response to a second pressure differential across the second sealed pressure chamber and prevents retraction of the second piston in the second direction The packer can further comprise a slip disposed on the mandrel adjacent the body that is movable outward from the mandrel with the setting force to engage the tubular.

The packer can further comprise: a first seal disposed on an outer surface of the first piston and sealably engaging an inner surface of the first housed area; and a second seal disposed on the internal surface of the first housed surface and sealably engaging the outer surface of the first piston, the first and second seals sealing the first sealed pressure chamber. Additionally, the packer can further comprise a third seal disposed between the second end of the first piston and the mandrel.

According to the present disclosure, a packer for sealing in a tubular, the apparatus comprises a mandrel, first and second pistons, a packing element, and first and second ratchet mechanisms. The mandrel defines housed areas, and the first and second pistons movably disposed on the mandrel respectively between the housed areas each have a first end defining a sealed pressure chamber with the respective housed area of the mandrel. The packing element is movably disposed on the mandrel between second ends of the first and second pistons. The packing element is compressible on opposing sides against the second ends of the first and second pistons in response to a setting force to seal against the tubular. The first and second ratchet mechanism are disposed respectively between the first and second piston and the first and second housed areas. The first and second ratchet mechanisms each in an initial condition permits movement of the respective piston in a first direction away from the packing element expanding the respective sealed pressure chamber, whereas the first and second ratchet mechanisms each in a subsequent condition permits urging of the respective piston in a second opposite direction toward the packing element in response to a respective pressure differential across the respective sealed pressure chamber and prevents retraction of respective piston in the first direction.

According to the present disclosure, an apparatus comprises a mandrel, a piston, an intermediate sleeve, and a body lock ring. The mandrel defines a housed area, and the piston movably disposed on the mandrel between the housed area has a first end defining a sealed pressure chamber with the housed area of the mandrel. The intermediate sleeve is disposed between the piston and the housed area and has an inside ratchet surface and an outside ratchet surface. The piston has an external ratchet surface configured to slip past the inside ratchet surface with movement of the piston in the first direction and configured to catch the inside ratchet surface with movement of the piston in the second direction. For its part, the body lock ring is disposed between the intermediate sleeve and the housed area. The body lock ring has an internal ratchet surface configured to catch the outside ratchet surface with movement of the intermediate sleeve in the first direction and configured to slip past the outside ratchet surface with movement of the intermediate sleeve in the second direction.

The body lock ring can comprises a wedged or perpendicular surface disposed on an upper side thereof and engaged with a complementary wedged or perpendicular surface disposed on an under side of the mandrel in the housed area. The complementary surfaces urged in the first direction causing radial contraction of the body lock ring and urged in the second direction permitting radial expansion of the body lock ring.

According to the present disclosure, a method of sealing in a tubular comprises: placing a packer in the tubular with a setting tool; applying a setting force with the setting tool between a mandrel and a packing element of the packer; sealing the packing element against the tubular in response to the applied setting force by compressing the packing element in a first direction against a second end of at least one piston movably disposed on the mandrel; urging the second end of the at least one piston in a second direction toward the compressed packing element in response to a pressure differential across at least one sealed pressure chamber defined between a first end of the at least one piston and at least one housed area of the mandrel; and limiting movement of the at least one urged piston in the first direction away from the compressed packing element.

Applying the setting force between the mandrel and the packing element of the packer can comprise applying relative movement between the mandrel and the second end of the at least one piston. Sealing the packing element against the tubular in response to the applied setting force can further comprise compressing against opposing sides of the packing element with the second ends of opposing ones of the at least one piston. Further, compressing the packing element against the second end of the at least one piston movably disposed on the mandrel can comprise temporarily affixing the at least one piston in place relative to the mandrel.

Urging the second end of the at least one piston in the second direction toward the compressed packing element in response to the pressure differential across the at least one sealed pressure chamber defined between the first end of the at least one piston and the at least one housed area of the mandrel can comprise breaking the temporary affixing of the at least one piston in place relative to the mandrel and moving the second end in the second direction toward the compressed packing element with reducing volume of the at least one sealed pressure chamber.

Limiting the movement of the at least one urged piston in the first direction away from the compressed packing element can comprise: slipping an external ratchet surface of the at least one piston against an inside ratchet surface of an intermediate sleeve with initial movement of the at least one piston in the first direction away from the packing element; shouldering the at least one piston in the first direction against the intermediate sleeve; and catching the external ratchet surface against the inside ratchet surface with subsequent movement of the at least one piston in the second direction toward the packing element.

Limiting the movement of the at least one urged piston in the first direction away from the compressed packing element can comprise: slipping an internal ratchet surface of a body lock ring against an outside ratchet surface of the intermediate sleeve with initial movement of the intermediate sleeve in the second direction toward the packing element; and catching the internal ratchet surface against the outside ratchet surface with subsequent movement of the intermediate sleeve in the first direction away from the packing element.

Slipping the internal ratchet surface against the outside ratchet surface of the intermediate sleeve with the initial movement of the intermediate sleeve in the second direction toward the packing element can comprise permitting radial expansion of the body lock ring, urged in the second direction, with complementary wedged surfaces disposed respectively on the upper side of the body lock ring and on an under side of the housed area.

Catching the internal ratchet surface against the outside ratchet surface with the movement of the intermediate sleeve in the first direction away from the packing element can comprise radially contracting the body lock ring, urged in the first direction, with the complementary wedges surfaces. Compressing the packing element against the second end of the at least one piston movably disposed on the mandrel can comprise breaching a temporarily connection affixing the at least one piston to the mandrel in response to a level of the setting force. The method can further comprise engaging a slip disposed on the mandrel against the tubular with the setting force.

The foregoing summary is not intended to summarize each potential embodiment or every aspect of the present disclosure.

DETAILED DESCRIPTION OF THE DISCLOSURE

Figure 1:
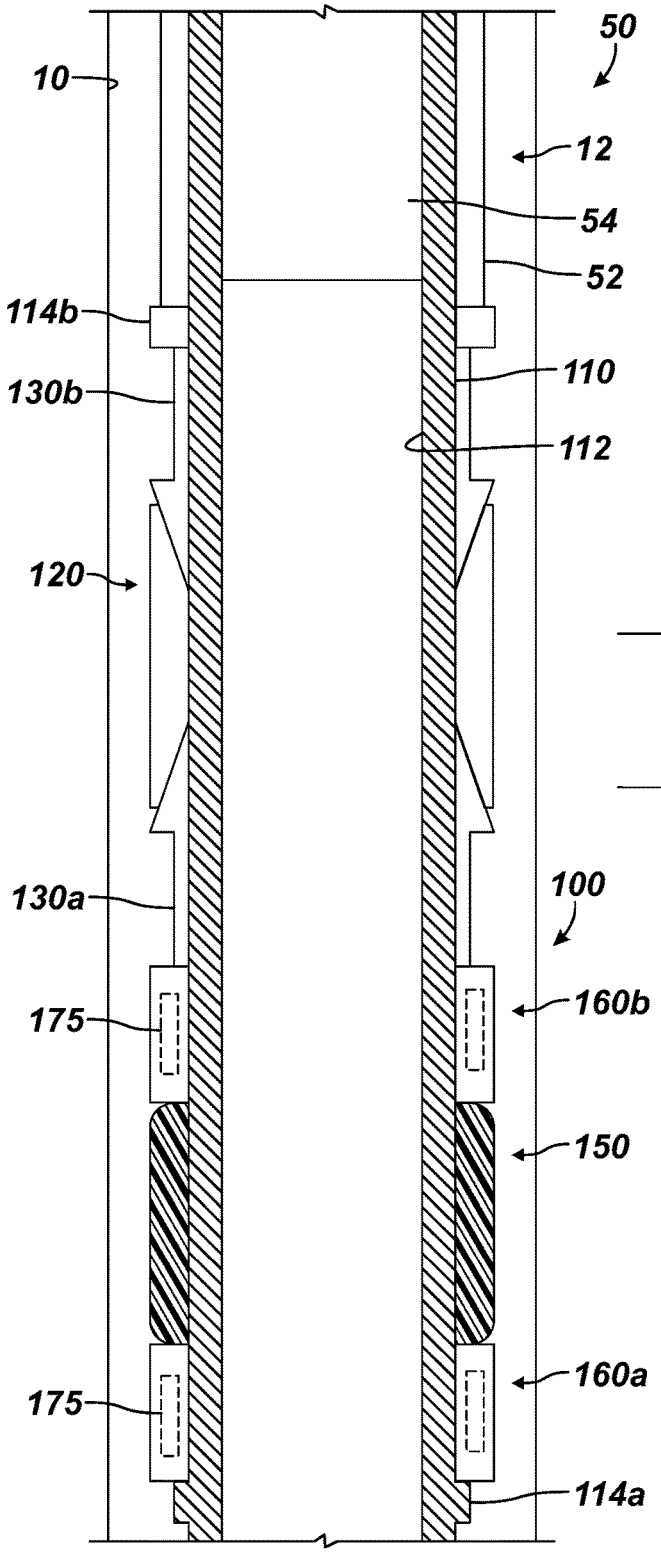
FIG. 1 illustrates a cross-sectional view of a packer according to the present disclosure run into casing.

Referring to FIG. 1, a packer 100 for setting in a wellbore is illustrated in cross-section. The packer 100 has been run into the wellbore and positioned inside a string of casing or other tubular 10. For example, the packer 100 can be run into the wellbore with a setting tool 50 on a work string or other conveying member, such as slick line or the like. Once the packer 100 is set to depth, the setting tool 50 actuates the packer 100 so a seal is created in the annulus 12 between the packer 100 and the surrounding casing string 10.

The packer 100 includes a mandrel 110 having a packing element 150 and at least one booster 160*a-b* disposed thereon. As shown, the packer 100 preferably has opposing boosters 160*a-b* disposed on both sides of the packing element 150.

The mandrel 110 extends along a length of the packer 100 and defines a tubular body with a bore 112 therein for fluid communication, which may be used to convey fluids during various wellbore operations, such as completion and production operations. An uphole end of the mandrel 110 may include connections for connecting to a tubular, a setting tool 50, a work string, or the like, and a downhole end of the mandrel 110 may be connected to a downhole tool (not shown), another tubular, or the like.

The packing element 150 disposed circumferentially around the outer surface of the mandrel 110 can be compressed to expand into contact with the surrounding casing 10 in response to axial compressive forces generated on either side of the packing element 150. To apply the compressive forces to the packing element 150, components on the mandrel 110 may move relative to each other, especially toward each other, in order to compress the packing element 150. In this manner, the annulus 12 between the packer 100 and the casing 10 can be fluidly sealed. Exemplary materials for the packing element 150 include rubber or other elastomeric material.

The packer 100 may further include an anchoring mechanism, such as one or more slips 120 situated between activation cones 130*a-b*. For example, a pair of cones 130*a-b* can be disposed on the mandrel 110 on each side of slips 120. During setting, the pair of cones 130*a-b* may be moved toward each other to urge or wedge the slips 120 into engagement with the casing 10 to anchor the packer 100.

To set the packer 100 and seal the packing element 150 in the casing 10, the setting tool 50 runs the packer 100 into position in the casing 10. After the packer 100 is positioned at the desired location, the packer 100 is set by applying an axial compressive force. In general, the setting tool 50 may be a hydraulic setting tool, a nonexplosive setting tool, or other type of setting tool to apply a setting force in the form of relative movement between the mandrel 110 and the components of the packer 100 on the mandrel 110.

Some existing packers must be set with a hydrostatic running tool, which converts the hydrostatic well pressure into an axial force. In some applications, use of a hydrostatic tool may not be desirable or possible. Although such a hydrostatic tool could be used to set the packer, another type of setting tool, such as the Weatherford nonexplosive setting tool (NEST), can be used to set the packer 100 of the present disclosure. The nonexplosive setting tool 50 can be a battery-operated, timer-based device that can set the packer 100 without the use of explosives. Run on slick-line or e-line, the nonexplosive setting tool 50 can have various timer settings that are set depending on the depth at which the packer 100 is to be deployed.

The nonexplosive setting tool 50 as compared to other setting tools used in the industry at the time of actuation moves at a very slow pace—i.e., fractions of an inch per second when setting a packer. A typical hydrostatic setting tool may move 7 inches in a second to set a packer, which is considered to be a fast set. Setting packers at a slow pace can be a disadvantage to such a packer with a boost mechanism as disclosed in U.S. Pat. No. 8,881,836 because the boosters will stroke out due to hydrostatic pressure in the well if not set at a fast speed. Once the boosters are fully stroked, no axial force is available to further energize the packing element. The boosters 160*a-b* of the disclosed packer 100 are not affected by hydrostatic pressures during run-in and setting.

For example, to apply the setting force between the mandrel 110 and the packing element 150, the setting tool 50 can releasably deploy the packer 100 using a first portion 52 engaged with a push ring or movable shoulder 114*b* on the packer's mandrel 110 and using a second portion 54 engaged with the mandrel 110. While the mandrel 110 is pulled/held by the second portion 54, the movable shoulder 114*b* engaged with the first portion 52 is moved on the mandrel 110 toward a fixed shoulder 114*a* of the mandrel 110 so the packer 150 and the slips 120 can be set against the casing 10.

In the setting, for example, the movable shoulder 114*b* and the fixed shoulder 114*a* are brought together so the cones 130*a-b* wedge the slips 120 outward, and the packing element 150 is compressed between the boosters 160*a-b*. The compressed packing element 150 expands outward to seal against the casing 10 to seal the annulus 12. As will be discussed in more detail below while the packing element 150 set, the boosters 160*a-b* can further urge toward the compressed packing element 150 in response to a pressure differential across sealed pressure chambers 175 defined within the boosters 160*a-b*.

Instead of being designed just for handling fluctuations in annular pressure, the boosters 160*a-b* of the packer 100 may be used to increase the seal load of the packing element 150. Typically, the initial seal load of the packing element 150 is determined by the setting force from the setting tool. In some applications, such as small bore operations, the seal load applied by a standard setting tool may be less than optimal. In such situations, the boosters 160*a-b* may advantageously function to further energize the packing element 150 to a higher seal load, thereby maintaining the seal when the packer 150 is exposed to a pressure greater than the set pressure.

Depending on the implementation, one or more packers 100 may be coupled together for use in isolating the annulus 12 in the casing 10. In one arrangement, for example, the packer 100 is run into the wellbore along with various other completion tools. For example, a polished bore receptacle may be used at the top of a liner string. The top end of the packer 100 may be threadably connected to the lower end of such a polished bore receptacle, which allows other component to be sealingly stabbed into the liner string once set in the casing 10. Commonly, the polished bore receptacle is used to later tie back to the surface with a string of production tubing. In this way, production fluids can be produced through the liner string, and upward to the surface through the tie back.

Figure 2:
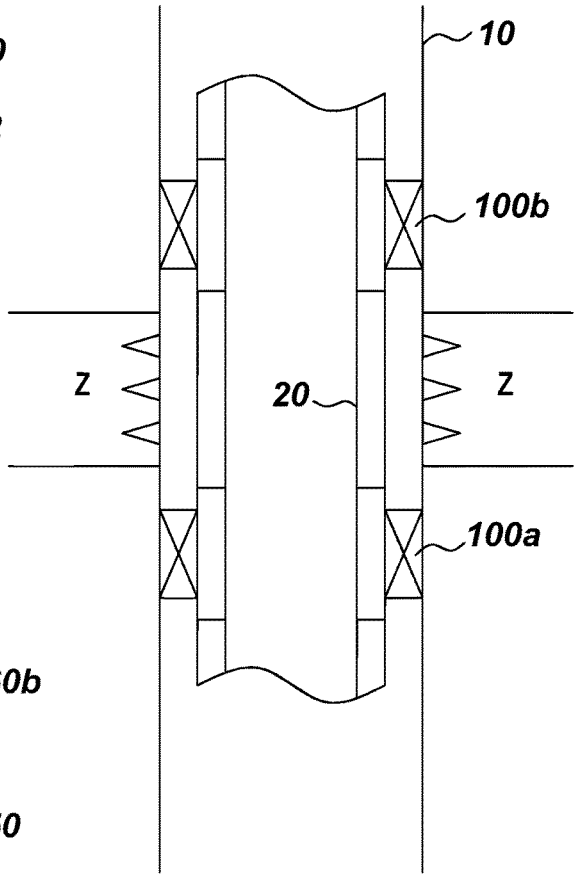
FIG. 2 illustrates a schematic view of two packers isolating a zone of interest.

As shown in another arrangement of FIG. 2, two packers 100*a-b* may be used to straddle a zone (Z) of interest to be isolated. A tubular 20, a liner, a downhole tool, or other component may be disposed between the two packers 100*a-b*.

In operation, the downhole packer 100*a* is run first into the wellbore and set at one end of the zone Z to be isolated. The uphole packer 100*b* is then run into wellbore and connected to the downhole packer 100*a*. If the intermediate component is a tubular 20, the tubular 20 is connected to a lower portion of the uphole packer 100*b* and connected to the downhole packer 100*a* using known techniques. The straddle is formed after the uphole packer 100*b* is set. It is contemplated that other deployment methods known of a person of ordinary skill may be used.

In the straddle assembly as in FIG. 2, any increase in the pressure inside or outside the isolated zone Z may boost the pressure on either side of the packing elements (150) from the direction of the increased pressure. These pressure fluctuations may be natural or artificial. For example, chemicals or fluids may be selectively injected into one or more zones (Z) in the wellbore for treatment thereof. The chemicals or fluids may be a fracturing fluid, acid, polymers, foam, or any suitable chemical or fluid to be injected downhole. These injections may cause a temporary increase in the pressure of the wellbore, which may act on the packing elements (150) of the packers 100*a-b*. The pressure increase causes the boosters (160*a-b*) of the straddle packers 100*a-b* to boost the internal pressure of the respective packing elements 150. The boosted pressures of the packers 100*a-b* are then locked in even after the temporary pressure increase subsides, such as during a reverse flow of the injected fluids.

In another example, the boosters (160*a-b*) of the packer 100 may independently react to pressure changes. For example, referring again to FIG. 2, the zone (Z) isolated by the straddle packers 100*a-b* may not be producing when the zones above and below the isolated zone (Z) are being produced. In this situation, the pressure in the producing zones may decrease, while the isolated zone may increase. This increase in pressure may act on the boosters (160*a-b*) of the packers 100*a-b* in the isolated zone (Z). If the zone's pressure is higher than the pressure of the seal load, the boosters (160*a-b*) may react by increasing the seal load, thereby maintaining the seal to isolate the zone (Z). In this respect, the boosters (160*a-b*) outside of the isolated zone (Z) are not affected by the pressure change in the isolated zone (Z).

Figure 3A:
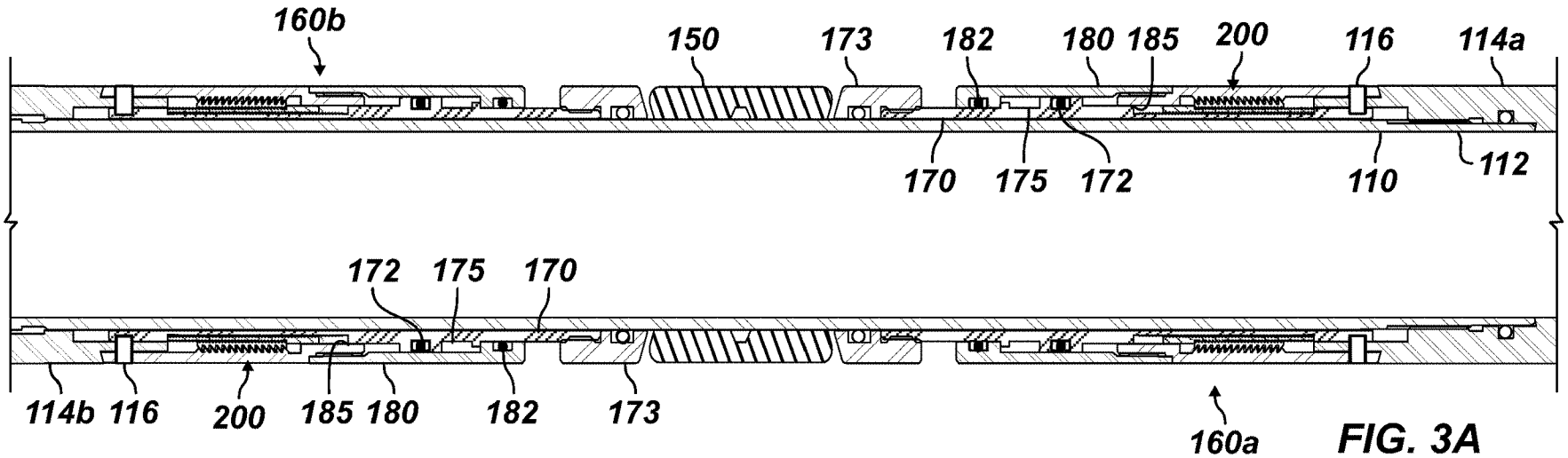
FIG. 3A illustrates a cross-sectional view of portion of the disclosed packer in a run-in position.
Figure 3B:
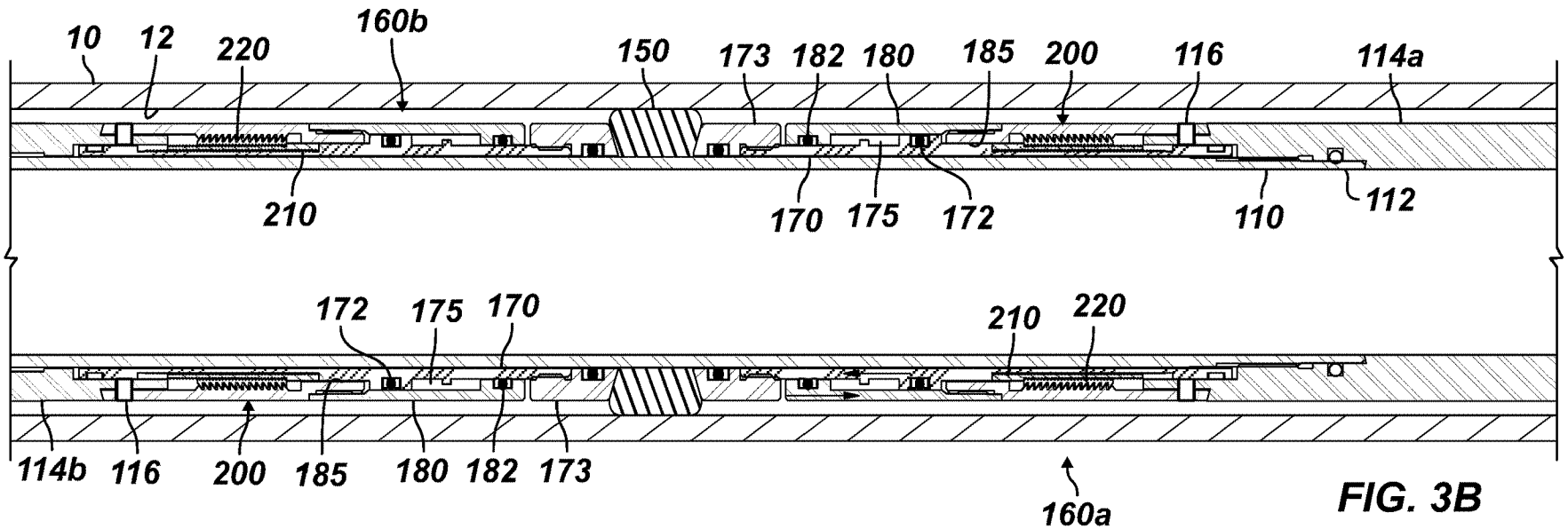
FIG. 3B illustrates a cross-sectional view of the portion of the disclosed packer in a pack-off position.

Having an understanding of the packer 100 and example ways the packer 100 can be used, discussion now turns to additional details of the boosters 160*a-b* of the packer 100. FIGS. 3A-3B illustrate portion of the disclosed packer 100 in more detail during unset and set conditions, respectively. As shown here, the mandrel 110 has the packing element 150 with opposing boosters 160*a-b* disposed on both sides.

The first (downhole) booster 160*a* is disposed adjacent the fixed shoulder 114*a* on the mandrel 110. The packing element 150 is situated between the downhole booster 160*a* and the second (uphole) booster 160*b*, which is disposed adjacent a movable shoulder 114*b* (push ring, or other component) disposed on the mandrel 110. For setting, the mandrel 110 is held/pulled while the movable shoulder 114*b* is moved along the mandrel 110 toward the fixed shoulder 114*a* so that the packing element 150 can be compressed against the casing 10. Although not shown in this embodiment, the packer 100 can have slips and cones disposed on the mandrel 110 beyond the movable shoulder 114*a*.

Both of the boosters 160*a-b* have a piston 170 movably disposed on the mandrel 110. The piston 170 is an internal sleeve having a distal end with a gage ring 173 that fits against one of the opposing sides of the packing element 150. A seal can be disposed between the gage ring 173 of the piston 170 and the mandrel 110 to prevent fluid leakage in the space between the piston 170 and the mandrel 110.

The pistons' proximal ends are disposed in housed areas 185 of the packer 110. The housed areas 185 are formed by external housing sleeves 180 affixed on the mandrel 110 respectively to the shoulders 114*a-b*. (As shown, both of these housing sleeves 180 can be formed from several interconnected sleeves extending from the respective shoulder 114*a-b*.) Respective seals 172, 182 on the pistons 170 and the housing sleeves 180 define sealed pressure chambers 175. The pressure in these chambers 175 is preferably less than the expected pressure in the wellbore, and more preferably, is about atmospheric. Depending on the implementation, other configured pressures can be used.

During run-in as shown in FIG. 3A, both of the pistons 170 are retracted away from the packing element 150, being temporarily held to the shoulders 114*a-b* with shearable members 116, such as shear screws. The shear rating of these shear screw 116 is selected so the screws 116 do not shear during run-in, but their rating is less than a setting force for the packer 100. In this respect, the shear screws 116 may serve to prevent premature or accidental movement of the piston 170.

As shown in FIG. 3B, the setting tool (not shown) applies a setting force so the moveable shoulder 114*b* and the mandrel 110 are moved relative to one another. The movable shoulder 114*b* moves the upper booster 160*b* toward the packing element 150, which is movably disposed on the mandrel 110. The upper booster's gage ring 173 presses against the packing element 150, which is compressed against the lower booster's gage ring 173 in response to the setting force. The compressed packing element 150 then expands outward toward the casing 10.

As can be seen, the setting force compresses the packing element 150 between the gage rings 173 of the pistons 170 of the boosters 160*a-b*. The movable shoulder 114*a* and the upper booster 160*a* (with its upper gage ring 173 and piston 170) are free to move into abutment with one side of the packing element 150 and free to move closer to the lower booster 160*b* and fixed shoulder 114*b*. In this manner, the packing element 150 is compressed and deformed into sealing engagement with the casing 10.

During this initial pack-off of the packing element 150, the shear screws 116 eventually break. At this point, the pistons 170 can shift further in the housed areas 185 by sliding through ratchet mechanisms 200 engaged between the pistons 170 and the housed areas 185. This outward shift of the pistons 170 is possible because components of the ratchet mechanisms 200 (inner ratchet sleeve 210 and booster lock ring 220) can move inside of the booster housings 180. The shift of the pistons 170 expands the sealed pressure chambers 175. During pack-off the pistons 170 can be stroked at any rate slow or fast. Eventually, the pistons 170 shoulder out and do not shift further, and the packing element 150 is packed off with the applied setting force.

As discussed below, the freed pistons 170 may allow for further boosting of the packing element 150. Briefly, with the pistons 170 stroked back, movement of the pistons 170 toward the packing element 150 can now occur because the pistons 170 will carry the inner ratchet sleeve 210 of the ratchet mechanism 200 so the two move as one due to internal threads locking up between them.

During boosting, the sealed chamber 175 collapses as the piston 170 can move in the opposite direction in response to hydrostatic pressure collapsing the chamber 175. At this point, the ratchet mechanism 200 locks or traps the movement of the piston 170 toward the packing element 150. In general, ratchet serrations on the lock mechanism 200 have previously allowed the pistons 170 to shift further outward from the packing element 150 with the breach of the shear screws 116. Yet, the ratchet serrations on the lock mechanism 200 allow the pistons 170 boosted by differential pressure in a manner described below to move toward the packing element 150 and to also lock the further compressive force in place against the packing element 150.

Figure 4:
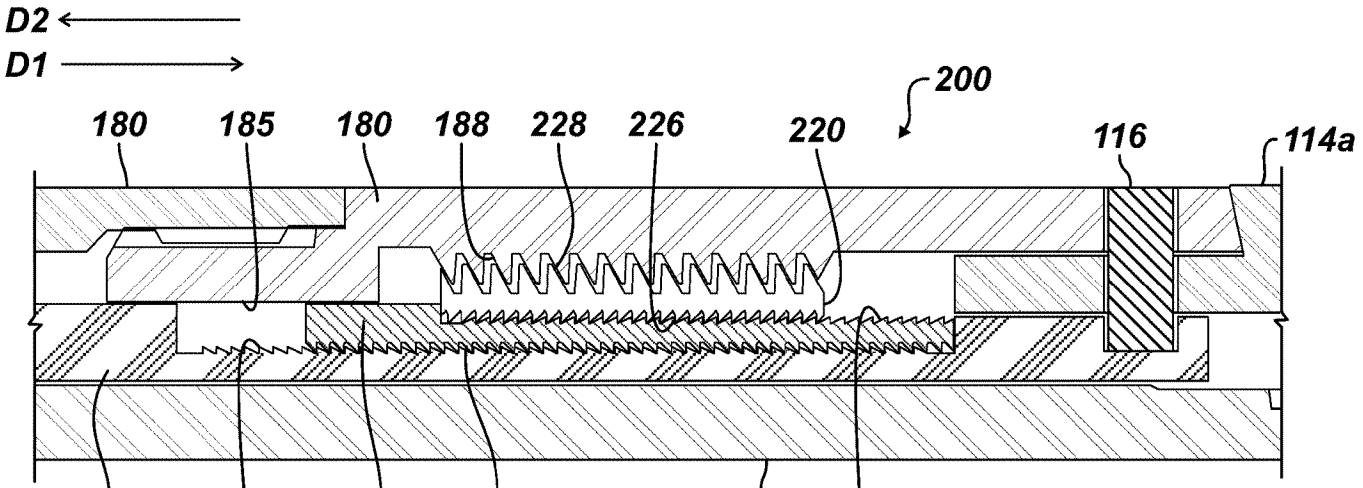
FIG. 4 illustrates a detailed cross-sectional view of the booster's ratchet mechanism.
Figure 5:
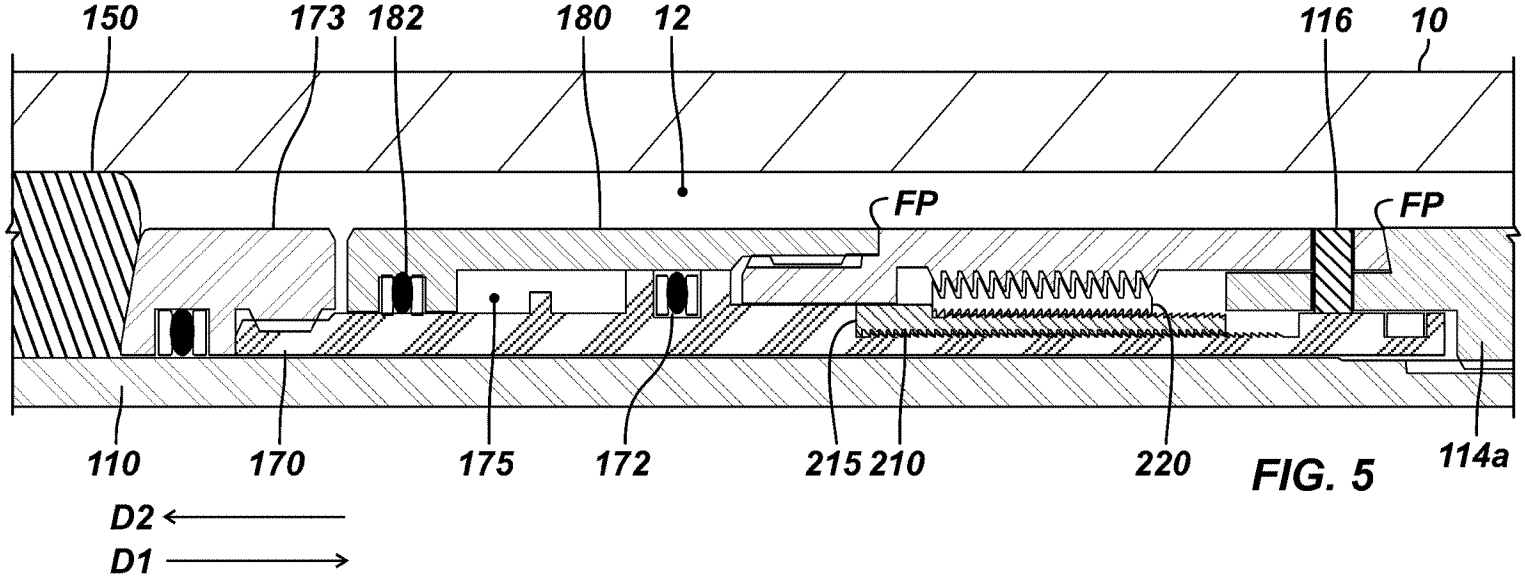
FIG. 5 illustrates a cross-sectional view of the booster before being boosted.

Details of the ratchet mechanism 200 are shown in FIGS. 4 and 5. In particular, FIG. 4 illustrates a detailed cross-sectional view of the booster's ratchet mechanism 200, and FIG. 5 illustrates a cross-sectional view of the booster 160*a* before being boosted.

As best shown in FIG. 4, the ratchet mechanism 200 includes an intermediate ratchet sleeve 210 and a body lock ring 220 disposed in the housed area 185 between the piston 170 and the housing sleeve 180. The piston 170 has an external ratchet surface 174 in the form of serrations or the like, and the ratchet sleeve 210 has a first (inner) ratchet surface 214 in the form of serrations or the like. Also, the ratchet sleeve 210 has a second (outer) ratchet surface 216 and the body lock ring 220 has an internal ratchet surface 226, both of which can be in the form of serrations or the like. In general, the ratchet serrations 226 on the body lock ring 220 cooperate with the serrations 216 on the ratchet sleeve 210, and the serrations 214 on the ratchet sleeve 210 cooperates with the serrations 174 on the piston 170 to prevent/allow movement of the piston 170.

In particular, the ratchet surfaces 174, 214 between the piston 170 and ratchet sleeve 170 (*i*) can slip past one another with movement of the piston 170 in a first direction D1 away from the packing element 150 (when the shear screws 116 shear) and (ii) can catch one another with reverse movement of the piston 170 in a second direction D2 toward the packing element 150 (when boosting occurs). Meanwhile, the ratchet surface 216, 226 between the ratchet sleeve 210 and the body lock ring 220 (*i*) can catch one another with movement of the ratchet sleeve 210 in the first direction D1 away from the packing element 150 (when the shear screws 116 shear) and (ii) can slip past one another with the reverse movement of the ratchet sleeve 210 in the second direction D2 toward the packing element 150 (when boosting occurs).

To allow for slippage and selective catching of the surfaces, the body lock ring 220 having the internal ratchet surface 226 on an underside thereof is able to adjust (expand and contract) between the housing sleeve 180 and the intermediate sleeve 210. During this expanding and contracting movement, the body lock ring 220 permits movement of the intermediate ratchet sleeve 210 in the first direction D1 and resists movement of the ratchet sleeve 210 in the second direction D2. In this way, the ratchet mechanism 200 allows the inner ratchet sleeve 210 to be stroked in the first direction D1 through the body lock ring 220. When stroked a second time in the reverse direction D2, the ratchet sleeve 210 can move back through the body lock ring 220, which can then lock-in the movement of the ratchet sleeve 210 and the caught piston 170.

In particular, the body lock ring 220 includes wedged or perpendicular thread 228 disposed on the upper side thereof that are engaged with complementary wedged or perpendicular thread 118 disposed on an under side of the housing sleeve 180. As noted above, the piston 170 has the connection or shear screw 116 temporarily affixing the piston 170 to the mandrel 110. The connection 116 breaks in response to the mechanical setting force applied in the first direction D1, which allows the piston 170 to shift further into the housed area 185 as depicted in FIG. 5.

The shifted piston's external ratchet surface 174 slips past the first ratchet surface 214 of the ratchet sleeve 210, the second ratchet surface 216 of the ratchet sleeve 210 engages the internal ratchet surface 226 of the body lock ring 220, and the complementary wedged thread 118, 228 with the body lock ring 220 urged in the first direction D1 cause the body lock ring 220 to contract radially. The sealed pressure chamber 175 expands with the shifting of the piston 170, and the piston 170 eventually shoulders against the end 215 of the ratchet sleeve 210. The ratchet mechanism 200 prevents further shifting of the piston 170 in the first direction D1.

All the while, the pressure chamber 175 remains sealed during the operation of the packer 100 and expands with the movement of the piston 170. As noted previously, for instance, the seal 172 disposed on an outer surface of the piston 170 sealably engages an inner surface of the housing sleeve 180. The other seal 182 disposed on the internal surface of the housing sleeve 180 sealably engages the outer surface of the piston 170.

During the life of the packer 100 once set as in FIG. 5, pressure fluctuations in the wellbore may serve to boost the pressure on the packing element 150. In particular, the booster 160*a* is coupled to the lower end 114*a* of the packer 100 in a manner that allows fluid pressure to enter fluid path(s) FP between the booster 160*a* and the lower end 114*a* of the packer 100. For example, a portion of the housing sleeve 180 may overlap the lower end 114*a* of the packer 100, and the piston 170 is positioned in the housed area 185. In this respect, fluid pressure in the annulus 12 may be communication through the fluid path(s) FP and exert a force in the second direction D2 on the piston 170. (Although only the lower booster 160*a* is shown in FIG. 5, the upper booster 160*b* may be similarly coupled to the movable shoulder 114*b* so fluid pressure in the annulus 12 may be communicated through fluid paths between the housing sleeve 180 and the movable shoulder 114*b* and exert a force on the upper booster's piston 170.)

An increase in the annulus pressure on the side of the packing element 150 is communicated to the piston 170 of the lower booster 160*a* through the fluid path(s) FP. The annulus pressure exerts a force on the piston 170 in the second direction D2, which overcomes the internal pressure of the packing element 150. As a result, the piston 170 urges the gage ring 173 toward the packing element 150 in response to the pressure differential across the sealed pressure chambers 175, and the lower pressure of the chamber 175 allows it to decrease in volume due to movement of the piston 170 relative to the housing sleeve 180.

(Meanwhile, movement of the piston 170 of the upper booster 160*a* can be locked in by the lock mechanism 200 so the pressure on the packing element 150 is maintained. Similarly, an increase in annular pressure on the other side of the packing element 150 can cause the other piston 170 of the upper booster 160 to apply an additional force on the packing element 150 on the opposite side.)

Force is created by the piston 170 against the side of the packing element 150 as the external pressure climbs, which increases the sealing pressure of the packing element 150. The piston chamber 175 collapses due to the external pressure surrounding the chamber 175, and the created force is applied by the piston 170 in the direction D2 toward the packing element 150. The inner ratchet sleeve 210 and piston 170 can ratchet through the booster lock ring 220 to trap force into the packing element 150.

In particular, with the shifting of the piston 170 in the second direction D2 during this process, the piston's external ratchet surface 174 catches the first ratchet surface 214 of the ratchet sleeve 210, while the second ratchet surface 216 of the ratchet sleeve 210 slips past the internal ratchet surface 226 of the body lock ring 220. The complementary wedged thread 118, 228 with the body lock ring 220 permit the body lock ring 220 to expand radially. As a result, the ratchet sleeve 210 is carried in the second direction D2 with the piston 170, and the sealed pressure chamber 175 decreases in volume with the shifting of the piston 170. Yet, the ratchet mechanism 200 prevents retraction of the piston 170 in the first direction D1 (i) because the piston 170 is shouldered against the end 215 of the ratchet sleeve 210 and (ii) because any movement in the reverse direction D1 (*a*) would cause the second ratchet surface 216 of the ratchet sleeve 210 to catch the internal ratchet surface 226 of the body lock ring 220 and (*b*) would cause the complementary wedged thread 118, 228 with the body lock ring 220 to radially contract the body lock ring 220.

As disclosed herein, the ratchet mechanism 200 is used to lock-in the pack-off force applied by the hydrostatic movement of the piston 170. The same ratchet mechanism 200 can be used to allow movement in one direction for devices other than a piston on a packer, such as for a mandrel manipulation in one direction to open a port when moved a second time. The ratchet mechanism 200 can be used in any application when movement in one direction does not cause the intended mechanism to operate but does when moved in opposite direction.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A packer for setting in a tubular with a setting force, the packer comprising:

a mandrel defining a first housed area;

a first piston movably disposed on the mandrel, the first piston having first and second ends, the first end defining a first sealed pressure chamber with the first housed area of the mandrel, the first piston having an external ratchet surface;

a packing element movably disposed on the mandrel and being compressible on a first side against the second end of the first piston in response to the setting force to seal against the tubular; and a first ratchet mechanism comprising an intermediate sleeve and a body lock ring, the intermediate sleeve disposed between the first piston and the first housed area and comprising a first ratchet surface and a second ratchet surface, the body lock ring disposed between the intermediate sleeve and the first housed area, the body lock ring having an internal ratchet surface, the first ratchet mechanism in an initial condition permitting movement of the first piston in a first direction away from the packing element expanding the first sealed pressure chamber, the external ratchet surface of the first piston being configured to slip past the first ratchet surface of the intermediate sleeve with the movement of the first piston in the first direction, the internal ratchet surface of the body lock ring being configured to catch the second ratchet surface of the intermediate sleeve with the movement of the intermediate sleeve in the first direction, the first ratchet mechanism in a subsequent condition permitting urging of the first piston in a second opposite direction toward the packing element in response to a first pressure differential across the first sealed pressure chamber and preventing retraction of the first piston in the first direction, the external ratchet surface of the first piston being configured to catch the first ratchet surface of the internal sleeve with the movement of the first piston in the second direction, the internal ratchet surface of the body lock ring being configured to slip past the second ratchet surface of the intermediate sleeve with the movement of the intermediate sleeve in the second direction.

2. The packer of claim 1, wherein the second end of the piston comprises a gage ring disposed adjacent the packing element.

3. The packer of claim 1, wherein the first piston comprises an internal sleeve movably disposed on the mandrel, and wherein the packer comprises an external sleeve affixed to the mandrel and disposed about the internal sleeve to define the first housed area, the internal and external sleeves having seals engaging one another in that a first seal on the internal sleeve engages the external sleeve and a second seal on the external sleeve engages the internal sleeve, the first and second seals sealing the first sealed pressure chamber therebetween.

4. The packer of claim 1, wherein the body lock ring comprises a wedged or perpendicular surface disposed on an upper side thereof and engaged with a complementary wedged or perpendicular surface disposed on an under side of the mandrel in the first housed area, the complementary surfaces urged in the first direction causing radial contraction of the body lock ring and urged in the second direction permitting radial expansion of the body lock ring.

5. The packer of claim 1, wherein the first piston comprises a connection temporarily affixing the first piston to the mandrel, the connection breaking in response to a level of the setting force.

6. The packer of claim 1, further comprising:

a body movably disposed on the mandrel on an opposite side of the packing element and defining a second housed area;

a second piston movably disposed on the mandrel, the second piston having third and fourth ends, the third end defining a second sealed pressure chamber with the second housed area of the mandrel; and a second ratchet mechanism disposed between the second piston and the second housed area, the second ratchet mechanism in an initial condition permitting movement of the second piston in the first direction away from the packing element expanding the second sealed pressure chamber, the second ratchet mechanism in a subsequent condition permitting urging of the second piston in the second opposite direction toward the packing element in response to a second pressure differential across the second sealed pressure chamber and preventing retraction of the second piston in the second direction.

7. The packer of claim 6, further comprising a slip disposed on the mandrel adjacent the body and being movable outward from the mandrel with the setting force to engage the tubular.

8. The packer of claim 1, comprising:

a first seal disposed on an outer surface of the first piston and sealably engaging an inner surface of the first housed area; and a second seal disposed on the internal surface of the first housed surface and sealably engaging the outer surface of the first piston, the first and second seals sealing the first sealed pressure chamber.

9. The packer of claim 1, further comprising a third seal disposed between the second end of the first piston and the mandrel.

10. A packer for sealing in a tubular, the apparatus comprising:

a mandrel defining first and second housed areas;

first and second pistons movably disposed on the mandrel, each of the first and second pistons having first and second ends, each first end defining a sealed pressure chamber with the respective one of the first and second housed areas of the mandrel;

a packing element movably disposed on the mandrel between the second ends of the first and second pistons, the packing element being compressible on opposing sides against the second ends of the first and second pistons in response to a setting force to seal against the tubular; and first and second ratchet mechanisms each comprising an intermediate sleeve and a body lock ring, each of the intermediate sleeves disposed between a respective one of the first and second pistons and a respective one of the first and second housed areas, each of the intermediate sleeves comprising a first ratchet surface and a second ratchet surface, each of the body lock rings disposed between a respective one of the intermediate sleeves and a respective one of the first and second housed areas, each of the body lock rings having an internal ratchet surface, the first and second ratchet mechanisms each in an initial condition permitting movement of the respective piston in a first direction away from the packing element expanding the respective sealed pressure chamber, each of the external ratchet surfaces of the respective piston being configured to slip past the first ratchet surface of the respective intermediate sleeve with the movement of the respective piston in the first direction, each of the internal ratchet surfaces of the respective body lock ring being configured to catch the second ratchet surface of the respective intermediate sleeve with the movement of the respective intermediate sleeve in the first direction, the first and second ratchet mechanisms each in a subsequent condition permitting urging of the respective piston in a second opposite direction toward the packing element in response to a respective pressure differential across the respective sealed pressure chamber and preventing retraction of respective piston in the first direction, each of the external ratchet surfaces of the respective piston being configured to catch the first ratchet surface of the respective intermediate sleeve with the movement of the first piston in the second direction, each of the internal ratchet surfaces of the respective body lock ring being configured to slip past the second ratchet surface of the respective intermediate sleeve with the movement of the respective intermediate sleeve in the second direction.

11. An apparatus, comprising:

a mandrel defining a housed area;

a piston movably disposed on the mandrel, the piston having first and second ends, the first end defining a sealed pressure chamber with the housed area of the mandrel;

an intermediate sleeve disposed between the piston and the housed area and having an inside ratchet surface and an outside ratchet surface, the piston having an external ratchet surface configured to slip past the inside ratchet surface with movement of the piston in a first direction and configured to catch the inside ratchet surface with movement of the piston in a second direction; and a body lock ring disposed between the intermediate sleeve and the housed area, the body lock ring having an internal ratchet surface configured to catch the outside ratchet surface with the movement of the intermediate sleeve in the first direction and configured to slip past the outside ratchet surface with the movement of the intermediate sleeve in the second direction, whereby the intermediate sleeve and the body lock ring in an initial condition permit the movement of the piston in the first direction expanding the sealed pressure chamber, and whereby the intermediate sleeve and the body lock ring in a subsequent condition permit urging of the piston in the second direction in response to a pressure differential across the sealed pressure chamber and preventing retraction of the piston in the first direction.

12. The apparatus of claim 11, wherein the body lock ring comprises a wedged or perpendicular surface disposed on an upper side thereof and engaged with a complementary wedged or perpendicular surface disposed on an under side of the mandrel in the housed area, the complementary surfaces urged in the first direction causing radial contraction of the body lock ring and urged in the second direction permitting radial expansion of the body lock ring.

13. A method of sealing in a tubular, the method comprising:

placing a packer in the tubular with a setting tool, the packer comprising: a mandrel defining at least one housed area; at least one piston movably disposed on the mandrel and having first and second ends, the first end defining at least one sealed pressure chamber with the at least one housed area, the at least one piston having an external ratchet surface; a packing element movably disposed on the mandrel; and at least one ratchet mechanism comprising an intermediate sleeve and a body lock ring, the intermediate sleeve disposed between the at least one piston and the at least one housed area and comprising a first ratchet surface and a second ratchet surface, the body lock ring disposed between the intermediate sleeve and the at least one housed area, the body lock ring having an internal ratchet surface;

applying, with the setting tool, a setting force between the mandrel and flail the packing element;

sealing the packing element against the tubular in response to the applied setting force by compressing the packing element against the second end of the at least one piston;

moving, with the at least one ratchet mechanism in an initial condition, the at least one piston in a first direction away from the packing element expanding the at least one sealed pressure chamber by slipping the external ratchet surface of the at least one piston past the first ratchet surface of the intermediate sleeve with the movement of the at least one piston in the first direction and catching the internal ratchet surface of the body lock ring to the second ratchet surface of the intermediate sleeve with the movement of the intermediate sleeve in the first direction; and urging, with the at least one ratchet mechanism in a subsequent condition, the at least one piston in a second opposite direction toward the compressed packing element in response to a pressure differential across the at least one sealed pressure chamber and limiting retraction of the at least one urged piston in the first direction away from the compressed packing element by catching the external ratchet surface of the at least one piston to the first ratchet surface of the intermediate sleeve with the movement of the at least one piston in the second direction and slipping the internal ratchet surface of the body lock ring past the second ratchet surface of the intermediate sleeve with the movement of the intermediate sleeve in the second direction.

14. The method of claim 13, wherein applying the setting force between the mandrel and the packing element of the packer comprises moving the mandrel and the second end of the at least one piston relative to one another.

15. The method of claim 13, wherein sealing the packing element against the tubular in response to the applied setting force further comprises compressing against opposing sides of the packing element with the second ends of opposing ones of the at least one piston.

16. The method of claim 13, wherein compressing the packing element against the second end of the at least one piston comprises temporarily affixing the at least one piston in place relative to the mandrel.

17. The method of claim 16, wherein urging the second end of the at least one piston in the second direction toward the compressed packing element in response to the pressure differential across the at least one sealed pressure chamber comprises breaking the temporary affixing of the at least one piston in place relative to the mandrel and moving the second end in the second direction toward the compressed packing element with reducing volume of the at least one sealed pressure chamber.

18. The method of claim 13, wherein limiting the retraction of the at least one urged piston in the first direction away from the compressed packing element comprises:

shouldering the at least one piston in the first direction against the intermediate sleeve.

19. The method of claim 13, wherein slipping the internal ratchet surface of the body lock ring against the second ratchet surface of the intermediate sleeve with the subsequent movement of the intermediate sleeve in the second direction toward the packing element comprises radially expanding the body lock ring, urged in the second direction, with complementary surfaces disposed respectively on an upper side of the body lock ring and on an under side of the at least one housed area.

20. The method of claim 19, wherein catching the internal ratchet surface of the body lock ring against the second ratchet surface of the intermediate sleeve with the movement of the intermediate sleeve in the first direction away from the packing element comprises radially contracting the body lock ring, urged in the first direction, with the complementary wedges surfaces.

21. The method of claim 13, wherein compressing the packing element against the second end of the at least one piston comprises breaching a temporarily connection affixing the at least one piston to the mandrel in response to a level of the setting force.

22. The method of claim 13, further comprising engaging a slip disposed on the mandrel against the tubular with the setting force.

* * * * *